United States Patent [19]

Bahr et al.

[11] 4,350,466

[45] Sep. 21, 1982

[54] APPARATUS FOR HANDLING ARTICLES

[75] Inventors: Melford J. Bahr, Corcoran; Wayne R. Geist, Rogers, both of Minn.

[73] Assignee: MGS Machine Corporation, Minneapolis, Minn.

[21] Appl. No.: 147,956

[22] Filed: May 8, 1980

[51] Int. Cl.[3] ..... B65H 3/12

[52] U.S. Cl. ..... 414/128; 271/95; 414/121

[58] Field of Search ..... 271/5, 94, 95; 414/5, 414/120, 121–123, 125, 128, 129

[56] References Cited

U.S. PATENT DOCUMENTS

| | | | |
|---|---|---|---|
| 2,810,575 | 10/1957 | Holmen | 271/95 |
| 2,855,113 | 10/1958 | Roske | 414/72 |
| 2,915,308 | 12/1959 | Matzen | 271/95 |
| 3,041,068 | 6/1962 | Schaltegger | 271/95 |
| 3,302,946 | 2/1967 | Anderson | 271/95 |

*Primary Examiner*—Duane A. Reger

*Attorney, Agent, or Firm*—Merchant, Gould, Smith, Edell, Welter & Schmidt

[57] ABSTRACT

An article-handling apparatus (10) for moving a single sheet or piece of material from a pile or tray thereof to a subsequent station is disclosed. The article-handling apparatus (10) is comprised of a drive shaft (16) and a plurality of support shafts (20) rotatably held by bearing mechanisms (2) on a hub (24) attached to the drive shaft (16). The support shafts (20) have axes substantially parallel to and spaced regularly from and about the drive shaft (16). The support shafts (20) have sprockets (26) attached to one end thereof for engagement with pins (18) fastened to support member (14) and regularly spaced along the circumference of a circle concentric to the drive shaft. Suction cup mechanisms (28) are adjustably clamped to the other end of support shafts (20).

A vacuum pump is in fluid communication with suction cup mechanisms (28) through a valve body (32). As support shafts (20) rotate clockwise as a unit about the axis of drive shaft (16), the suction cup mechanisms (28) additionally rotate counter-clockwise about the axis of the particular support shafts (20) to which each is attached. At the same time, the suction cup mechanisms (28) are placed alternately in fluid communication with the vacuum pump and the atmosphere through valve body (32).

18 Claims, 4 Drawing Figures

APPARATUS FOR HANDLING ARTICLES

FIELD OF THE INVENTION

This invention relates to an article-handling apparatus and, more particularly, to an apparatus which can move a single sheet or piece of material from a pile or tray thereof and advance the same to a subsequent station.

BACKGROUND OF THE INVENTION

Various types of devices having a similar article-handling purpose have been known. Such devices have been used, for example, in the printing industry to remove a sheet of paper from the top or end of a pile thereof and transfer the sheet to a second location such as to a conveyor which moves the sheet into a press or other machine. Such devices have also been used in the container-manufacturing industry to denest plastic trays or to pick coupons or premiums from a stack or tray and advance them to a moving conveyor for placement thereon or insertion within a container thereon. Additionally, in conjunction with various glue applicators, one such coupon-type sheet may be moved from a pile, advanced past a glue applicator, and placed in sticking contact with a carton. Some devices operate to pick and open folded cartons.

One known device, disclosed in U.S. Pat. No. 2,810,575, is used specifically for counting banknotes. The device includes a planetary gear member provided with internal teeth which serves to rotate mating gear members or a plurality of shafts having vacuum sucking mechanisms attached thereto. The device, however, does not pick up a banknote and physically move it to a subsequent station; rather it simply pivots the banknote about one end. The note is in contact with the vacuum mechanism for a suitably short time and released when a following vacuum mechanism has moved to prevent the note from swinging back to its original position.

Other devices are known which physically pick an article from a magazine or tray and move it to a subsequent station. These other devices, however, have complex gear mechanisms with a minimal capability for adjustment as required for various projects. For example, one such device, disclosed in U.S. Pat. No. 2,915,308, includes a drive shaft having a gear thereon, a plurality of support shafts having vacuum mechanisms and small drive gears thereon, and a plurality of third gears for location between the drive shaft gear and the gears on the support shafts.

Another device, disclosed in U.S. Pat. No. 3,041,068, uses gears on the support shafts which hold vacuum mechanisms. These mechanisms roll directly on a gear attached to the drive shaft. Additionally, however, there exist a series of gears and chains between a power source and the drive shaft.

Thus, many of the known devices use a complex number and arrangement of gears and other apparatus, and, consequently, are expensive to buy and maintain. Others of the known devices have limited capability. There exists a need for an article-handling apparatus which can move an article from a first station to a second station, but yet is relatively simple, economical, and versatile.

SUMMARY OF THE INVENTION

The present invention is comprised of a support member, a drive shaft attached rotatably to and extending from the support member, means for rotatably driving the drive shaft, a plurality of support shafts having axes substantially parallel to and spaced from and about the drive shaft, means for rotatably driving the support shafts, a suction cup attached to each of the support shafts, means for producing a vacuum, and means for alternately connecting the suction cups with the vacuum-producing means and the atmosphere. The means for rotatably driving the support shafts include means for rotatably holding each support shaft such that the axes of the support shafts remain in a constant spacial relationship relative to the drive shaft. Also, the means for rotatably driving the support shafts include a means for engaging and rotating the support shafts in a direction opposite from the drive shaft as the drive shaft and the support shafts rotate as a unit relative to the support member.

In a preferred embodiment, a drive shaft is rotatably supported by a support member. The drive shaft is rotated about its axis by a motor. Four support shafts are held generally parallel to and equidistantly spaced from and about the drive shaft. The support shafts are rotatably held by a hub which is attached to and rotates with the drive shaft so that the rotary motion of the drive shaft causes each of the support shafts to revolve in a circle about the drive shaft. Each of these support shafts supports one or more vacuum suction cups. The above-mentioned support member also includes a plurality of pins which are attached substantially parallel to the support shafts. The pins have centers regularly spaced along the circumference of a circle concentric to the drive shaft. Each support shaft has a sprocket attached thereto such that the sprockets engage the pins and rotate about the interior of the circle described by the pins. Since the drive shaft and the support shafts rotate as a unit, the sprockets in engagement with the pins cause the support shafts to rotate in a direction opposite from the rotational direction of the drive shaft. The suction cups follow a hypotrochoidal path.

A vacuum application mechanism operates to apply a vacuum to each of the suction cups in a regular sequence. Atmospheric pressure is applied between the periods of vacuum application. The vacuum application mechanism is comprised of a vacuum source connected by a tube through the support member to a valve body. The valve body is fixed relative to the support member, but is in sliding contact with the hub which holds the support shafts. The hub acts as a manifold and is connected to a non-rotating, low-friction bearing block on each support shaft. Air is drawn from a suction cup through a flexible tube to the interior of the particular support shaft. From the interior of the support shaft, the air passes through the low-friction bearing block to the manifold and valve body and continues through tubing to the vacuum pump.

As the motor drives the shafts, the valve body places suction cups alternately in fluid communication with the vacuum source and the atmosphere. While a suction cup is in fluid communication with the vacuum source, the suction cup can pick a coupon or other article from a suitably located tray mechanism and hold it until the valve body places the suction cup in fluid communication with the atmosphere. At that subsequent station and time, the coupon or other article is released.

The invention is comparatively simple in that it uses a single central drive shaft and four surrounding support shafts. The support shafts are rotated relative to the drive shaft by the attachment of a sprocket to each support shaft such that the sprocket engages a series of pins attached in a circular pattern on a support member. Rather than an expensively machined planetary gear or a series of complexly aligned gears, the invention uses commercially-available sprockets on support shafts and a simply fabricated support member with pins to simulate a planetary gear.

The speed of the article-handling apparatus may be varied not only by varying the speed of the drive motor, but also by interchanging the sprockets on the support shafts and substituting a support member having pins placed therein in a larger or smaller diameter circle. It has been found that the invention is easily capable of one hundred article placements per minute per suction cup.

A further advantage of the invention is that the suction cups are movable longitudinally on each support shaft because of the flexible tube used to provide fluid communication between the hollow support shaft and the suction cups. Additionally, a plurality of suction cups may be used on each support shaft.

For a better understanding of the invention, its advantages, and objects attained by its use, reference should be had to the drawings which form a further part hereof, and to the accompanying descriptive matter in which there are illustrated and described preferred and other embodiments of the invention.

DESCRIPTION OF THE PREFERRED EMBODIMENTS

Figure 1:
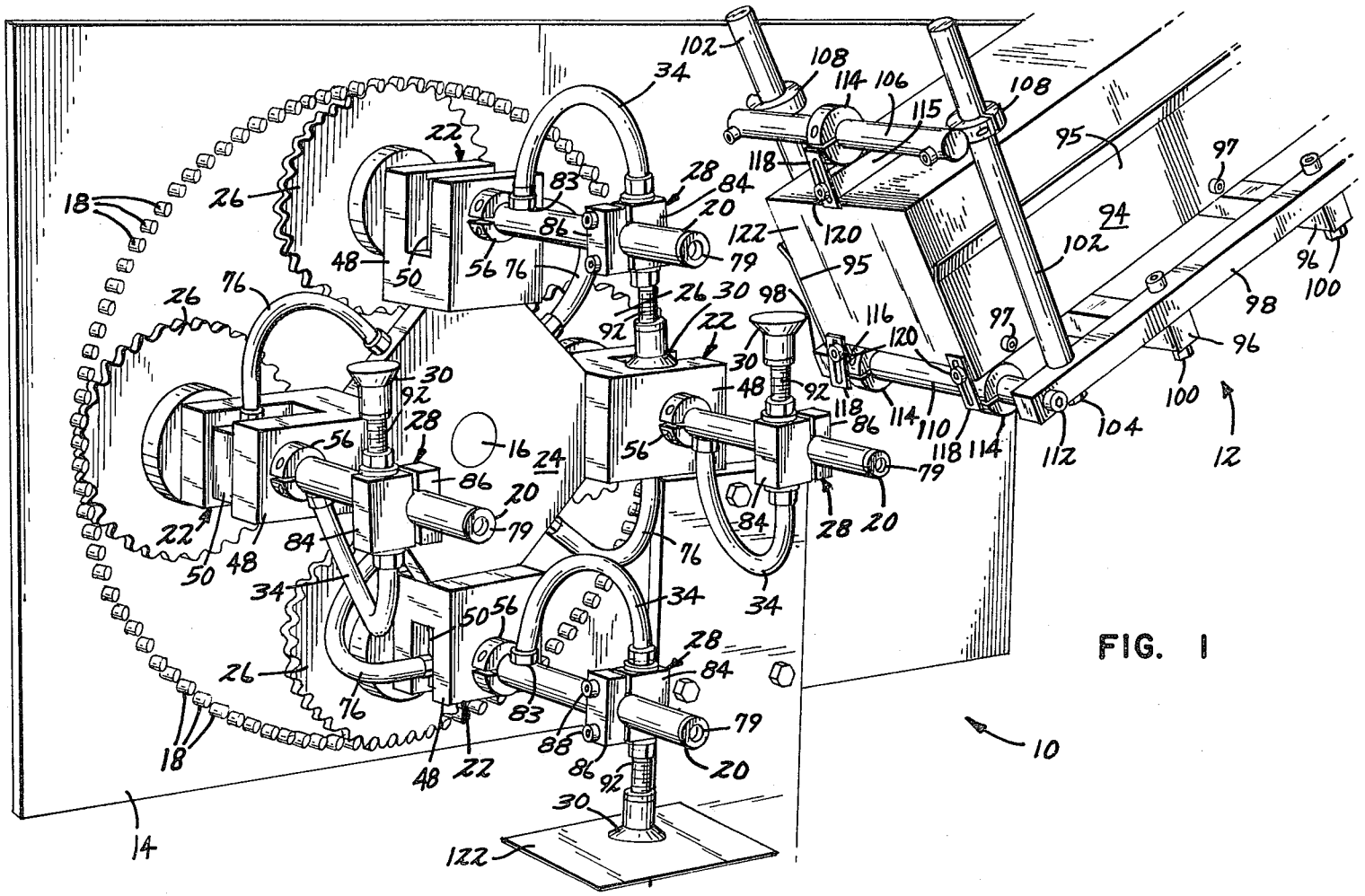
FIG. 1 is a perspective view of the invention.

Referring now to the drawings wherein like reference numerals designate identical or corresponding parts throughout the several views, and more particularly to FIG. 1, an article handling apparatus is designated generally as 10 and a tray mechanism is designated generally as 12.

In a preferred embodiment, support member 14 not only supports drive shaft 16, but also holds a plurality of pins 18 equidistantly spaced along the circumference of a circle concentric to drive shaft 16. Four support shafts 20 are individually held by bearing mechanisms 22 on hub 24 about drive shaft 16. A sprocket 26 is fixed to the end of each support shaft 20 adjacent support member 14. A suction cup mechanism 28 is fastened to the opposite end portion of each support shaft 20. Support shafts 20 rotate as a unit with drive shaft 16 about its axis as drive shaft 16 is driven, and at the same time, pins 18 engage sprockets 26 causing support shafts 20 to rotate individually in a direction opposite the rotational direction of drive shaft 16.

Vacuum is applied by a vacuum pump (not shown) through a series of flexible, tubular lines and other components to the suction cups 30 which are a part of the suction cup mechanisms 28. The vacuum pump is in fluid communication with a valve body 32 (see FIG. 3) and hub 24, which, having a series of passageways therein, functions as a manifold. As hub 24 rotates with drive shaft 16 relative to nonrotatable valve body 32, which is in sealing contact with hub 24, air passes through valve body 32 and a particular set of passageways in hub 24. Each passageway in hub 24 is in fluid communication with a particular bearing mechanism 22 which in turn is in fluid communication with the hollow center portion of the particular support shaft 20. A flexible line 34 places suction cup mechanism 28 in fluid communication with the center of the support shaft 20. As the drive shaft 16 rotates, each suction cup mechanism 28 is alternately placed through valve body 32 in fluid communication with the suction pump and the atmosphere.

The article handling apparatus 10 is operable when a particular suction cup 30 is both in fluid communication with the vacuum pump and positioned to be in facial contact with an article held by tray mechanism 12. The vacuum causes an article to adhere to the particular suction cup 30 and rotate with it until the suction cup is placed in fluid communication with atmospheric pressure.

Figures 3, 4:
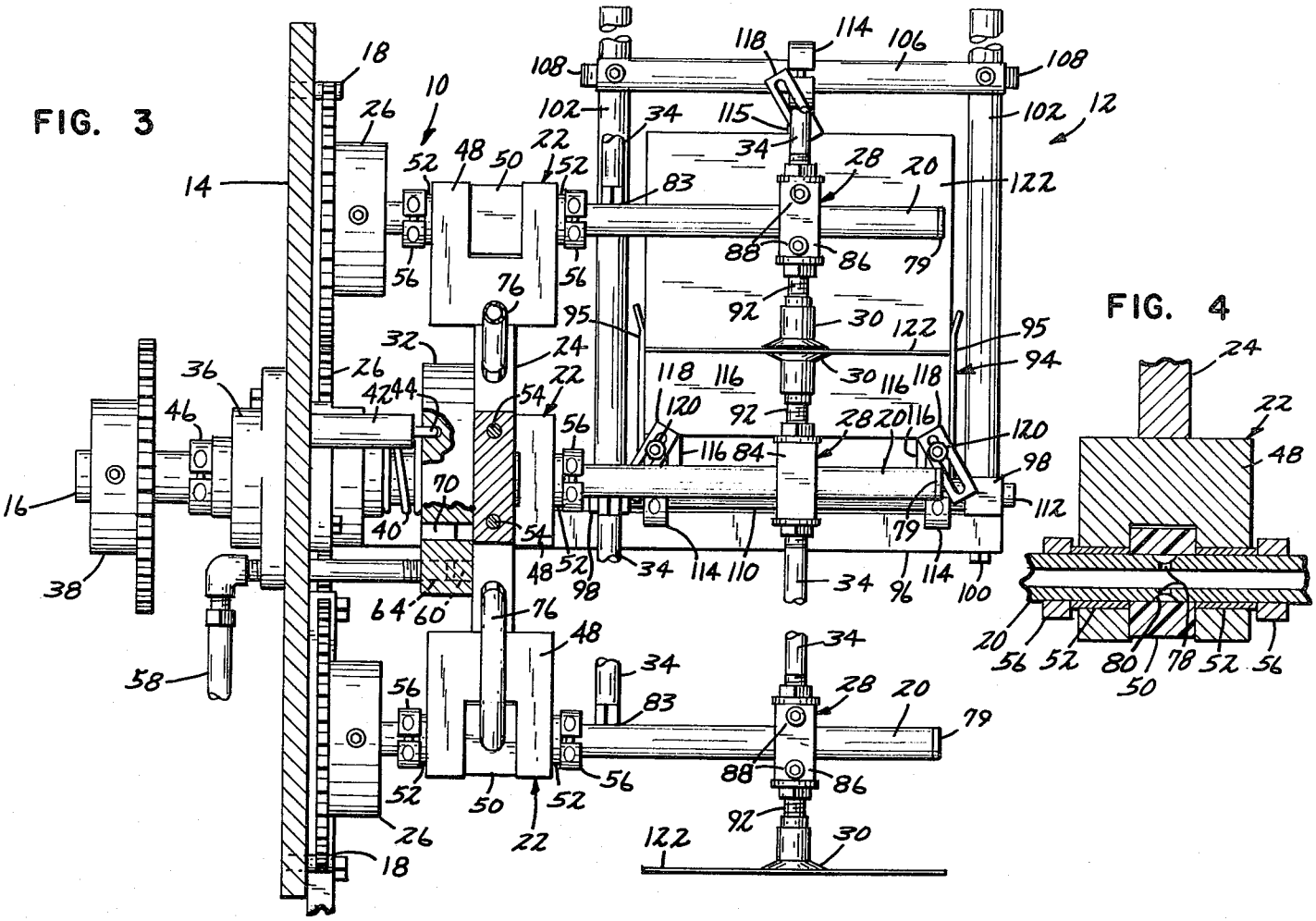
FIG. 3, although a cross-sectional view of the invention taken along line 3—3 of FIG. 2, is essentially a side view of the invention.
FIG. 4 is a cross-sectional view of the bearing mechanism holding a support shaft relative to the hub, taken along line 4—4 of FIG. 2.

Describing the structure more particularly, support member 10 may assume a variety of shapes or consist of various ancillary structure as long as the area inside a circle which includes pins 18 is flat. Drive shaft 16 extends through support member 14. Bearing 36, of a type commonly known, holds drive shaft 16 rotatably relative to support member 14. Rotative energy may be provided, of course, to drive shaft 16 by any of various power sources. One means is to attach a sprocket 38, as shown in FIG. 3, to one end of drive shaft 16 and connect a chain between sprocket 38 and a motor (not shown). Hub 24 is fixedly attached to the other end of drive shaft 16. Valve body 32 encircles drive shaft 16 at a location between bearing 36 and hub 24. Valve body 32 is forced into fluid-sealing contact with hub 24 by spring 40, compressively placed between bearing 36 and valve body 32 in an encircling fashion about drive shaft 16. Valve body 32 is supported on drive shaft 16 by a bearing (not shown) and is held nonrotatably with respect to support member 14 by stud 42 and pin 44. Stud 42 is attached by a screw or other fastener (not shown) to support member 14 and extends from it. Pin 44 has one end pressed or otherwise fastened into the projecting end of stud 42 with a second end inserted into a closely fitting hole in valve body 32. Collar 46 located between pulley 38 and bearing 36 holds shaft 16 longitudinally with respect to support member 14 and provides an adjustment for the compressible force applied by spring 40. That is, as drive shaft 16 is moved longitudinally to position hub 24 closer to support member 14, valve body 32 is moved closer to bearing 36 thereby compressing spring 40. Collar 46 holds drive shaft 16 and thus spring 40 in its compressed configuration. The compressed state of spring 40 is varied by moving collar 46 longitudinally on drive shaft 16. The adjustment is necessary to balance the fluid-sealing efficiency between valve body 32 and hub 24, which is better as compression force is increased, against frictional force and heat buildup, which is higher as compression force is increased.

Hub 24 can assume a variety of different shapes. As shown in a preferred embodiment in FIG. 2, however, hub 24 has a substantially octagonal outer periphery. In this configuration, bearing mechanisms 22 are fastened to alternate edge surfaces of hub 24. Each bearing mechanism 22 is comprised of a U-shaped member 48, as shown in FIG. 3, and a low-friction block 50 of material like nylon. The U-shaped member 48 has a base portion and two leg portions rising therefrom. A mechanical bearing 52, of a type commonly known, is fastened within each leg portion of the U-shaped member 48. The low-friction block 50 has an opening passing transversely through it of diameter slightly larger than the diameter of a support shaft 20. The low-friction block 50 is fastened between the leg portions of the U-shaped member 48. With a U-shaped member 48 attached to hub 24 with screws 54 (see FIG. 2), the bearings 52 and the opening in the low-friction block 50 are located such that a support shaft 20 passing therethrough is held approximately parallel to drive shaft 16. Collars 56 are fastened to the support shaft 20 on either side of the bearing mechanism 22 to hold support shaft 20 longitudinally fixed relative to bearing mechanism 22.

Sprocket 26, of a type commonly known, is fastened to one end of support shaft 20 between bearing mechanism 22 and support member 14. As indicated previously, pins 18 are pressed into holes or otherwise fastened to support member 14 in a regularly spaced arrangement along the circumference of a circle concentric to drive shaft 16. The diameter of the circle is such that pins 18 register in the indentations of sprockets 26 as the support shafts 20 rotate with drive shaft 16. Thus, sprockets 26 and pins 18 cause the support shafts 20 to rotate in a direction opposite to the rotational direction of drive shaft 16 as the several shafts rotate as a unit.

The vacuum application mechanism for article handling apparatus 10 includes a commonly-known vacuum pump (not shown). Line 58, shown in FIG. 3, provides fluid communication between the vacuum pump and valve body 32. Line 58 is variously comprised of tubular hoses and fittings as are well-known in the art. Line 58 is supported by support member 14 so that only a short straight portion of line 58 runs between support member 14 and valve body 32.

Figure 2:
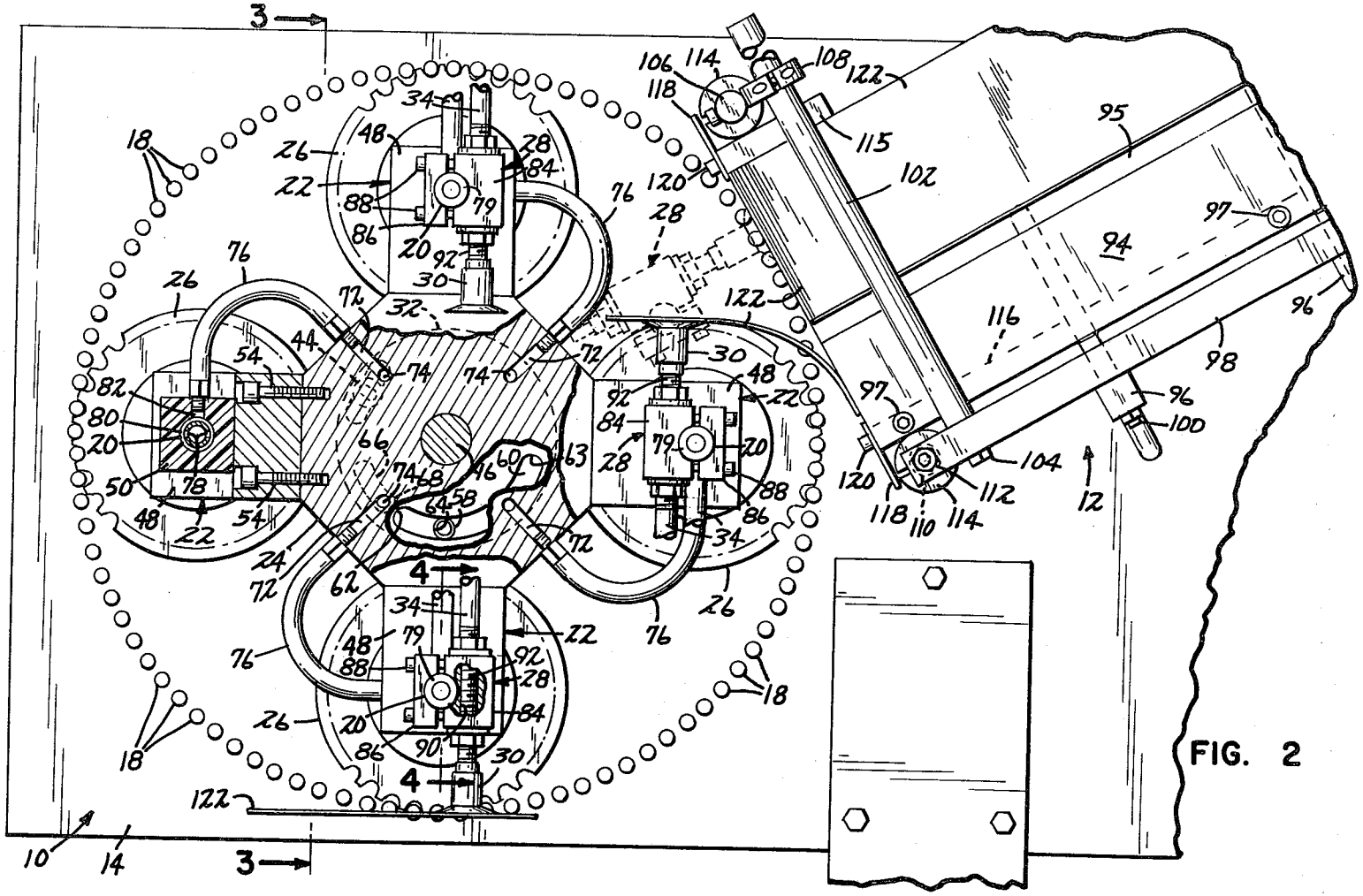
FIG. 2 is an elevational view of the article handling side of the invention with portions cut away.

Valve body 32 is shown with broken lines in FIG. 2 with some details also visible in FIG. 3. Valve body 32 has a long slot segment 60 centered on the circumference of a circle concentric with drive shaft 16. The ends of slot 60 are semi-circular. Slot 60 extends counterclockwise upwards from end 62 when viewing the valve body 32 from the side which contacts hub 24 to end 63. An opening 64 passes through valve body 32 in order to provide fluid communication between line 58 and slot 60 (see FIG. 3). A second smaller slot 66 is located along the circumference of the same circle as slot 60 clockwise upwards from end 62 of slot 60. The semi-circular ends of slot 66 are located between radial lines having an internal angle of roughly 10° to 30°. An opening 70 passes through valve body 32 at lowermost slot end 68 in order to provide fluid communication between slot 66 and the atmosphere (see FIG. 3). The hole in valve body 32 for pin 44 extends only partway into valve body 32 from the side opposite hub 24. The hole for pin 44 is located so as not to interfere with slots 60 and 66. Valve body 32 has sufficient width to accomodate slots 60 and 66. The peripheral shape of valve body 32 is not particularly important as long as valve body 32 is sufficiently large to include the indicated slots and holes.

As shown in FIG. 2, hub 24 has passageways 72 extending inwardly from approximately the center of each of the octagonal edges between the various bearing mechanisms 22. Each passageway 72 extends inwardly to a point approximately the same distance from the axis of drive shaft 16 as the inner edge of slot 60 and slot 66. Each passageway 72 is vented at its inner end with an opening 74 toward valve body 32. In this manner, hub 24 acts as a manifold with each passageway 72 alternately coming into registration with slot 60 and slot 66 of valve body 32 as the shaft 16 is rotated, thereby placing each passageway alternately in fluid communication with the vacuum pump and the atmosphere.

The angular orientation of valve body 32 with respect to the orientation of hub 24 at the moment a passageway 72 first comes into fluid communication with slot 60 during a revolution of hub 24 determines the relative location of a particular support shaft 20 when vacuum is first applied to the particular support shaft 20 and suction cup mechanism 28 in fluid communication with the particular passageway 72. Adjustment of the orientation of the suction cup mechanisms 28 and the tray mechanism 12 relative to each other insures coupon 122 pickup shortly after vacuum application. The length of slot 60 and subsequent proximity of slot 66 determine the duration of vacuum application to a particular suction mechanism 28 and resultant orientation of same when it is placed in fluid communication with the atmosphere. As shown in FIG. 2, if the end 63 of slot 60 is located somewhat below the horizontal relative to drive shaft 16, then a particular suction cup mechanism 28 is ready to pick a coupon when the particular support shaft 20 for mechanism 28 is somewhat above the indicated horizontal. The end 68 of slot 66 is commonly located to allow suction cup mechanism 28 to be placed in fluid communication with the atmosphere just before support shaft 20 for mechanism 28 is vertically below drive shaft 16. The end 62 of slot 60 and end 68 of slot 66 are commonly in relatively close proximity.

Each passageway 72 is connected at its end away from valve body 32 by a line 76 to a low-friction block 50 of a different bearing mechanism 22. A particular line 76 includes a tube and various fittings as is well-known in the art, to make the connections at hub 24 and one of the low-friction blocks 50. The low-friction block 50 is a mechanism for providing fluid communication between a particular hollow, rotating support shaft 20 and line 76 connected to hub 24. Low-friction block 50 is fastened to U-shaped member 48 so that it is non-rotatable with respect to hub 24 and, consequently, slides about the surface of support shaft 20 as support shaft 20 rotates. Each support shaft 20 has an opening 78 (see FIG. 4) passing between its hollow interior and its outer surface. Each support shaft 20 also has a plug 79 at each end thereof to maintain fluid communication integrity in the vacuum application mechanism. The opening 78 corresponds in location to a circular slot 80 in the outer surface of each support shaft 20. A passageway 82 in a particular low-friction block 50 extends from slot 80 in the relevant support shaft 20 to one of the side surfaces of low-friction block 50 between the leg portions of U-shaped member 48. Line 76 is connected with low-friction block 50 at passageway 82.

As shown in FIG. 1, line 34 provides fluid communication between the hollow portion of support shaft 20 and the suction cup mechanism 28. One end of line 34 is connected to an opening 83 which extends through the wall of support shaft 20 to the hollow portion of support shaft 20. Opening 83 is located adjacent the collar 56 on the side of bearing mechanism 22 away from support member 14. Line 34 is comprised of flexible tubing and standard fittings well-known in the art.

Suction cup mechanism 28, also shown in FIG. 1, includes a clamp having a body member 84 and a clamp member 86. The clamp is made from a rectangular block having thickness greater than the internal diameter of line 34. A hole having diameter approximately equal the outer diameter of a support shaft 20 is formed through the block at a location laterally centered and longitudinally nearer one edge. The block is cut transversely along a line passing through the center of the hole to form body member 84 and clamp member 86. Screws 88 pass through openings in clamping member 86 on either side of support shaft 20 into corresponding threaded openings in body member 84. In this manner, screws 88 tighten clamp member 86 and body member 84 onto support shaft 20 so a suction cup mechanism 28 may be longitudinally and angularly adjusted along support shaft 20. A passageway 90 passes transversely through body member 84 so as to bypass support shaft 20. Line 34 is connected to passageway 90 on the side of body member 84 which is up when the suction cup mechanism 28 is vertically below drive shaft 16. Suction cup 30 is connected via non-flexible line 92 to the other end of passageway 90. Suction cup 30 has a hole in the outer surface of the cup placing the cup volume adjacent the outer surface of the cup in fluid communication through a passageway in suction cup 30 with line 92 and ultimately the vacuum pump. Suction cup 30 is a commonly-known, commercially-available part.

As indicated previously, a suction cup mechanism 28 attracts and holds a coupon or other article from a suitable pile, stack or tray mechanism. One type of suitable tray mechanism is shown in FIG. 1. Tray mechanism 12 includes a container 94 having two sides 95 and a substantially open bottom having only a bar 116 attached lengthwise to the lower portion of each side 95 with screws 97. Container 94 is angularly raised with respect to the horizontal at its non-dispensing end and is approximately perpendicular to support shafts 20. Container 94 rests on a support structure comprised of two spaced-apart, bottom support bars 96 and two side support bars 98. The bottom support bars 96 are attached at one end to support member 14 and extend outwardly from it. The side support bars 98 run approximately parallel to and on either side of container 94 and are attached with screws 100 to bottom support bars 96. A post 102 rises upwardly at approximately a right angle from each of side support bars 98 near the ends thereof at the dispensing end of tray mechanism 12. Posts 102 are attached to side support bars 98 with screws 104. An upper, cross post 106 extends between posts 102 at a location above container 94 with coupons 122 therein and is attached to posts 102 with vertically-adjustable collar clamps 108. Similarly, a lower, cross post 110 extends between side support bars 98 and is attached to them with screws 112. A horizontally-adjustable, collar clamp 114 encircles upper cross post 106, and two similar collar clamps 114 encircle lower cross post 110. A short bar 115 is attached at its upper surface to the upper collar clamp 114. Bars 116 are attached at the lower surfaces of each to the respective lower collar clamps 114. Retainers 118 are attached with screws 120 to the ends of bars 115 and 116 at the dispensing end of tray mechanism 12. A stack of coupons 122 rests edgewise on the two lower bars 116 with the face of the lower-most coupon resting against retainers 118. It is preferable for tray mechanism 12 to be oriented with its dispensing end downward so coupons 122 are gravitationally forced to continually press against retainers 118.

In operation, the drive shaft 16 of the article handling apparatus 10 is driven by a motor or other power means through a chain about sprocket 38. At the same time, a vacuum pump operates to draw air from suction cups 30. Support shafts 20 are connected by bearing mechanisms 22 and hub 24 to drive shaft 16 and, consequently, rotate as a unit about drive shaft 16 and maintain a constant spacial relationship relative thereto. Sprockets 26 attached to the ends of drive shafts 20 engage pins 18 and cause support shafts 20 to rotate individually in a direction opposite the rotational direction of drive shaft 16 as drive shaft 16 and support shafts 20 rotate as a unit. Thus, when drive shaft 16 rotates clockwise as viewed from the article handling side of support member 14, the axis of a particular support shaft 20 maintains a constant spacial relationship relative to drive shaft 16 by moving clockwise therewith. The support shaft 20, however, also rotates individually in a counter-clockwise direction. Thus, a particular suction cup 30, located along a radius extending from the axis of a particular support shaft 20, moves counterclockwise on a clockwise hypotrochoidal path.

Valve body 32 is fixed relative to hub 24 which rotates with drive shaft 16. Consequently, a suction cup 30 connected to a particular support shaft 20 is in fluid communication with the vacuum pump only when the opening 74, with which the particular suction cup 30 is in fluid communication, is also in fluid communication with slot 60 of valve body 32. In like manner, the suction cup 30 is in fluid communication with the atmosphere only when the applicable opening 74 is in fluid communication with slot 66 of valve body 32. Thus, a particular suction cup 30 has a vacuum applied to it when the applicable opening 74 first registers with slot 60. Vacuum continues to be applied as opening 74 moves along slot 60. As opening 74 moves clockwise from the end 62 of slot 60 to the end 68 of slot 66, the suction cup 30 is no longer in fluid communication with the vacuum pump, but, due to the integrity of the fluid communication lines, a vacuum continues to be maintained until opening 74 registers with slot 66. At that point, the vacuum is lost and suction cup 30 is placed in fluid communication with the atmosphere. The pressure at suction cup 30 remains at the atmospheric level until opening 74 again registers with slot 60.

A suction cup apparatus 28 is shown in FIG. 2 in broken lines in an orientation relative to tray mechanism 12 where vacuum is first applied and a coupon 122 is first caused to adhere to the suction cup 30. With the drive shaft 16 having moved approximately 30° clockwise, the same suction cup 30 is shown in solid lines in FIG. 2 holding a coupon 122 as the coupon 122 is being pulled from tray mechanism 12. The lowermost suction cup apparatus 28 in FIG. 2 shows the orientation of a suction cup 30 at approximately the time the particular opening 74 registers with slot 66, thereby allowing suction cup 30 to release coupon 122. Thus, it is apparent that the article handling apparatus 10 readily moves a coupon or other article from a tray mechanism 12 or other similar apparatus to a subsequent station for placement. Furthermore, it is apparent that article handling apparatus 10 operates with a minimal number of sprockets and shafts and with a group of interacting components which are readily adjustable depending on the particular project to be completed.

Although numerous characteristics and advantages of the invention have been set forth in the foregoing description, together with details of the structure and function of the invention, it is to be understood that the disclosure is illustrative only. Any changes made, especially in matters of shape, size, and arrangement, to the full extent extended by the general meaning of the terms in which the appended claim are expressed, are within the principle of the invention.

What is claimed is:

1. An apparatus for handling articles, comprising:
a support member;
a drive shaft attached rotatably to and extending from said support member;
means for rotatably driving said drive shaft;
a plurality of support shafts having axes substantially parallel to and spaced from and about said drive shaft;
means for rotatably driving said support shafts including means for rotatably holding each said support shaft such that the axes of said support shafts remain in a constant spatial relationship relative to said drive shaft and means for engaging so that said support shafts rotate in a direction opposite from said drive shaft as said drive shaft and said support shafts rotate as a unit relative to said support member, said engaging means including a sprocket attached to each said support shaft and planetary gear means, immovable relative to said support member, for engaging the outer circumference of said sprockets and causing said sprockets to roll along the interior of a circle, whereby said sprockets and said support shafts are caused to rotate in a direction opposite from the rotational direction of said drive shaft when said sprockets engage said planetary gear means as said drive shaft and said support shafts rotate as a unit;
a suction cup attached to each said support shaft;
means for producing a vacuum; and
means for alternately connecting each said suction cup with said vacuum producing means and the atmosphere, whereby the article is moved from a first location to a second location as said drive shaft and said support shafts rotate, said suction cups attracting and holding said articles when suction cups are connected with said vacuum producing means and releasing said articles when said suction cups are connected with the atmosphere.

2. An apparatus for handling articles, comprising:
a support member;
a drive shaft attached rotatably and substantially perpendicular to said support member;
means for rotatably driving said drive shaft;
a plurality of support shafts having axes substantially parallel to and approximately equally spaced from and about said drive shaft;
means for rotatably holding each said support shaft such that the axes of said support shafts remain in a constant spatial relationship relative to said drive shaft;
a plurality of pins oriented substantially parallel to said support shafts and fixedly attached to said support member, said pins regularly spaced along the circumference of a circle concentric to said drive shaft;
sprocket means, attached to each said support shaft, for engaging said pins when said drive shaft and said support shafts rotate as a unit, said pins causing said sprocket means and said support shafts to rotate in a direction opposite to the rotational direction of said drive shaft;
a suction cup attached to each said support shaft;
means for producing a vacuum; and
means for alternately connecting each said suction cup with said vacuum producing means and the atmosphere, whereby the article is moved from a first location to a second location as said drive shaft and said support shafts rotate, said suction cups attracting and holding said articles when said suction cups are connected with said vacuum producing means and releasing said articles when said suction cups are connected with the atmosphere.

3. An apparatus for handling articles in accordance with claim 2 wherein said holding means includes a substantially symmetrical hub having two sides and a peripheral edge, said hub fastened at its center to said drive shaft; said holding means further including a plurality of U-shaped blocks having a base and two vertical legs, the base of said blocks fastened to the peripheral edge of said hub with the vertical legs of said U-shaped blocks rising away from the peripheral edge of said hub; and said holding means further including a bearing fastened to each vertical leg of said U-shaped blocks, said bearings in a single U-shaped block rotatably holding a particular said support shaft, whereby said support shafts are rotatably supported with axes substantially parallel to and spaced from and about said drive shaft by said hub, said U-shaped blocks and said bearings.

4. An apparatus for handling articles in accordance with claim 3 wherein said connecting means includes a valve body fixed relative to said support member and having a surface in substantial planar contact with said hub, said valve body having in its contact surface a slotted circular segment concentric with said drive shaft and also having in its contact surface an opening in fluid communication with the atmosphere, whereby said suction cups are placed alternately in fluid communication with said vacuum producing means and the atmosphere as said connecting means connects first through the slotted segment of said valve body and second through the opening to atmosphere of said valve body.

5. An apparatus for handling articles in accordance with claim 4 wherein said connecting means includes passageways through said hub, said hub having in its contact surface with said valve body openings equidistantly spaced about said drive shaft, the openings being centered on the circumference of a circle having a diameter matching the median diameter of the slotted circular segment in said valve body, each opening in said hub being in fluid communication with a different one of said passageways extending through the interior of said hub to its peripheral edge, whereby said connecting means connects said suction cups alternately in fluid communication with said vacuum producing means and the atmosphere as said hub rotates with respect to said valve body, thereby allowing each opening in said hub plate to register first with the slotted circular segment in said valve body and thereafter with the opening in said valve body which is in fluid communication with the atmosphere.

6. An apparatus for handling articles in accordance with claim 5 further comprising a spring encircled about said drive shaft between said support member and said valve body, said spring compressively-forcing said valve body against said hub to maintain an air sealing relationship between said valve body and said hub.

7. An apparatus for handling articles, comprising:
a support member;
a drive shaft attached rotatably to and extending from said support member;

means for rotatably driving said drive shaft;

a plurality of support shafts having axes substantially parallel to and spaced from and about said drive shaft;

means for rotatably driving said support shafts including means for rotatably holding each said support shaft such that the axes of said support shafts remain in a constant spatial relationship relative to said drive shaft and means for engaging so that said support shafts rotate in a direction opposite from the rotational direction of said drive shaft as said drive shaft and said support shafts rotate as a unit relative to said support member;

a suction cup attached to and oriented approximately perpendicularly from each said support shaft;

means for producing a vacuum; and means for alternately connecting each said suction cup with said vacuum producing means and the atmosphere, said connecting means including valve means for switching fluid communication from said suction cups between said vacuum producing means and the atmosphere, manifold means for dividing fluid communication from said valve means to said plurality of suction cups, and a plurality of identical communicating means for providing fluid communication between said manifold means and said suction cup, each said communicating means including first directing means for directing fluid from said manifold means, connective bearing means for transferring fluid from said first directing means to a particular said support shaft, and second directing means for directing fluid from said support shaft to said suction cup adjustably located anywhere along said support shaft, whereby said article is moved from a first location to a second location as said drive shaft and said support shafts rotate, said suction cups attracting and holding said articles when said suction cups are connected with said vacuum producing means and releasing said articles when said suction cups are connected with the atmosphere.

8. An apparatus for handling articles in accordance with claim 7 wherein said connective bearing means includes a block of low friction material encircled about said particular support shaft, said block being held fixed relative to said manifold means and having a passageway from an outer edge to an inner surface, the inner surface being in contact with said support shaft, and wherein said particular support shaft is hollow and is sealed at its ends, said particular support shaft having an opening from its hollow interior to an annular groove adjacent said block providing fluid communication between the passageway in said low-friction block and the hollow interior of said support shaft, whereby said block provides a bearing surface allowing said support shaft to rotate relative to said manifold means while at the same time providing fluid communication between said first directing means and said support shaft.

9. An apparatus for handling articles in accordance with claim 8 wherein said holding means includes a substantially symmetrical hub having two sides and a peripheral edge, said hub fastened at its center to said drive shaft; said holding means further including a plurality of U-shaped blocks having a base and two vertical legs, the base of said blocks fastened to the peripheral edge of said hub with the vertical legs of said U-shaped block rising away from the peripheral edge of said hub; and said holding means including a bearing fastened to each vertical leg of said U-shaped blocks, said bearings in a single U-shaped block rotatably holding a particular said support shaft; and wherein a particular said low-friction block is attached between the vertical legs of a particular said U-shaped block; whereby said low-friction block is held fixed relative to said manifold means by attachment to said U-shaped blocks and said support shafts are rotatably supported with axes parallel to and spaced from and about said drive shaft, by said hub, said U-shaped blocks and said bearings.

10. An apparatus for handling articles in accordance with claim 7 further comprising a plurality of means for adjustably clamping a particular said suction cup to a particular said support shaft and wherein said second directing means includes a flexible tube, whereby said adjustable clamping means and said flexible tube allow said suction cup to be adjustably oriented about and positioned along said support shaft.

11. An apparatus for handling articles, comprising:

a support member;

a drive shaft attached rotatably and substantially perpendicular to said support plate;

means for rotatably driving said drive shaft;

a substantially symmetrical hub fastened at its center to said drive shaft;

a plurality of U-shaped blocks having a base and two vertical legs, said blocks equidistantly spaced from and about said drive shaft and fastened to the peripheral edge of said hub, the vertical legs of said U-shaped blocks rising away from the peripheral edge of said hub;

a mechanical bearing fastened within each vertical leg of said U-shaped blocks;

a plurality of support shafts, rotatably held within said bearings fastened within a single said U-shaped block whereby the axes of said support shafts are substantially parallel to and equidistantly spaced from and about said drive shaft;

a sprocket fixedly attached to each said support shaft;

a plurality of pins oriented substantially parallel to said support shafts and attached to said support member, said pins being regularly spaced along the circumference of a circle concentric to said drive shaft such that said sprockets engage said pins when said drive shaft and said support shafts rotate as a unit, said pins causing said sprockets and said support shafts to rotate in a direction opposite to the rotational direction of said drive shaft;

a suction cup attached to and oriented approximately perpendicularly from each said support shaft;

means for producing a vacuum;

means for alternately connecting each said suction cup with said vacuum producing means and the atmosphere, said connecting means including valve means for switching fluid communication from said suction cups between said vacuum producing means and the atmosphere, manifold means for dividing fluid communication from said valve means to said plurality of suction cups, and a plurality of identical communicating means for providing fluid communication between said manifold means and said suction cup attached anywhere along a particular said support shaft;

whereby said article is moved from a first location to a second location as said drive shaft and said support shafts rotate, said suction cups attracting and holding said articles when said suction cups are connected with said vacuum producing means and releasing said articles when said suction cups are connected with the atmosphere.

12. An apparatus for handling articles in accordance with claim 11 wherein said connecting means further includes a plurality of nylon blocks, a particular said nylon block being encircled about a particular said support shaft, said particular nylon block held fixed relative to said manifold means by attachment between the vertical legs of a particular said U-shaped block, said particular nylon block having a passageway from an outer edge to an inner surface, the inner surface being in contact with said particular support shaft; said connecting means further including first directing means for directing fluid from said manifold means to the passageway in said particular nylon block and second directing means for directing fluid from a particular support shaft to said suction cup attached to said particular support shaft; and wherein said particular support shaft is hollow and includes plugs at its ends, said particular support shaft having an opening from its hollow interior to an annular groove adjacent said block providing fluid communication between the passageway in said block and the hollow interior of said support shaft, whereby said nylon block provides a bearing surface allowing said support shaft to rotate relative to said manifold means while at the same time providing fluid communication between said first directing means and said particular support shaft, said second directing means providing fluid communication between said particular support shaft and said suction cup attached to said particular support shaft.

13. An apparatus for handling articles in accordance with claim 12 further comprising a plurality of means for adjustably clamping a particular said suction cup to a particular said support shaft and wherein said second directing means includes a flexible tube, whereby said adjustable clamping means and said flexible tube allow said suction cup to be adjustably oriented about and positioned along said support shaft.

14. An apparatus for handling articles in accordance with claims 9, or 13 wherein said valve means includes a valve body fixed relative to said support member, said valve body having a surface in substantial planar contact with said hub and having in its contact surface a slotted circular segment concentric with said drive shaft and also having in its contact surface an opening in fluid communication with the atmosphere, whereby said suction cups are placed alternately in fluid communication with said vacuum producing means and the atmosphere as said manifold means first registers in fluid communication with the slotted segment of said valve body and second with the opening to atmosphere of said valve body.

15. An apparatus for handling articles in accordance with claim 14 wherein said manifold means includes said hub adapted to have passageways extending therethrough, said hub having in its contact surface with said valve body openings equidistantly spaced about said drive shaft, the openings being centered on the circumference of a circle having a diameter matching the median diameter of the slotted circular segment in said valve body, each opening in said hub being in fluid communication with a different passageway extending through the interior of said hub to its peripheral edge, whereby said manifold means connects said suction cups alternately in fluid communication with said vacuum producing means and the atmosphere as said hub rotates with respect to said valve body, thereby allowing each opening in said hub to register first with the slotted circular segment in said valve body and thereafter with the opening in said valve body.

16. An apparatus for handling articles in accordance with claim 15 further comprising a spring encircled about said drive shaft between said support member and said valve body, said spring compressively-forcing said valve body against said hub to maintain an air sealing relationship between said valve body and said hub.

17. An apparatus for handling articles, comprising:

a support member;

a drive shaft attached rotatably to and extending from said support member;

means for rotatably driving said drive shaft;

a plurality of support shafts having axes substantially parallel to and spaced from and about said drive shaft;

means for rotatably driving said support shafts including means for rotatably holding each said support shaft such that the axes of said support shafts remain in a constant spatial relationship relative to said drive shaft and means for engaging so that said support shafts rotate in a direction opposite from said drive shaft as said drive shaft and said support shafts rotate as a unit relative to said support member, said engaging means including a sprocket attached to each said support shaft and plurality of pins oriented substantially parallel to said support shafts and attached to said support member, said pins having centers regularly spaced along the circumference of a circle concentric to said drive shaft, the circle having a radius such that the outer circumference of said sprockets engage said pins when said drive shaft and said support shafts rotate as a unit:

a suction cup attached to each said support shaft;

means for producing a vacuum; and means for alternately connecting each said suction cup with said vacuum producing means and the atmosphere, whereby the article is moved from a first location to a second lcoation as said drive shaft and said support shafts rotate, said suction cups attracting and holding said articles when said suction cups are connected with said vacuum producing means and releasing said articles when said suction cups are connected with the atmosphere.

18. An apparatus for holding articles, comprising:

a support member;

a hub having a periphery and being rotatably supported by said support member;

means for driving said hub;

suction means, spaced about the periphery of and supported by said hub, for attracting and holding said articles;

means for periodically producing a vacuum in said suction means;

driven means for moving said suction means relative to said hub; and planetary gear means for engaging said driven means as said driving means moves said hub, said planetary gear means including a plurality of pins attached to said support member, said pins being regularly spaced along a circle centered on the rotatable axis of said hub;

whereby said suction means moves articles from first to second locations.

* * * * *